United States Patent [19]

Komazaki et al.

[11] Patent Number: 4,891,615

[45] Date of Patent: Jan. 2, 1990

[54] DIELECTRIC FILTER WITH ATTENUATION POLE

[75] Inventors: Tomokazu Komazaki; Katsuhiko Gunji; Norio Onishi; Yoshimitu Sakurai; Hiroyuki Horii; Akira Mashimo, all of Tokyo, Japan

[73] Assignee: Oki Electric Industry Co., Ltd., Tokyo, Japan

[21] Appl. No.: 285,527

[22] Filed: Dec. 16, 1988

[30] Foreign Application Priority Data

Dec. 28, 1987 [JP] Japan ..... 62-329513

[51] Int. Cl.[4] ..... H01P 1/202

[52] U.S. Cl. ..... 333/206; 333/202; 333/222

[58] Field of Search ..... 333/202, 206, 207, 208, 333/222, 223, 224, 219, 209, 210, 134, 212

[56] References Cited

U.S. PATENT DOCUMENTS 4,431,977 2/1984 Sokola et al. ..... 333/206
4,692,725 9/1987 Fukasawa et al. ..... 333/203
4,742,562 5/1988 Kommrusch ..... 333/134 X

FOREIGN PATENT DOCUMENTS 61-80901 4/1986 Japan .
61-84101 4/1986 Japan .

*Primary Examiner*—Eugene R. Laroche
*Assistant Examiner*—Seung Ham
*Attorney, Agent, or Firm*—Wenderoth, Lind & Ponack

[57] ABSTRACT

A dielectric filter with an attenuation pole having sharp attenuation characteristics. The dielectric block employed in the present dielectric includes a dielectric block single-block formed of $TiO_2$ or BaO, for example. The dielectric block of this type has a plurality of resonators extending from a top surface toward a bottom surface thereof, a plurality of adjusting patterns provided over the top surface thereof, an outer conductor formed by side surfaces and the bottom surface thereof, input and output electrodes, wherein the adjusting patterns, the outer conductor, input and output electrodes maybe plated, for example, by silver, and an insulated cable which may have one end connected to the outer conductor and another end connected to the output electrode is disposed over the plurality of resonators so as to be coupled thereto.

22 Claims, 3 Drawing Sheets

DIELECTRIC FILTER WITH ATTENUATION POLE

BACKGROUND OF THE INVENTION

Field of the Invention and Related Art

The present invention relates to a dielectric filter with an attenuation pole that is particularly adapted for use in an antenna of a mobile phone system.

There are many known techniques relating to a ceramic bandpass filter to be used in a mobile phone.

FIG. 1 shows a typical example of these techniques which comprises an integral dielectric single-block 101 (hereinafter referred to as simply the dielectric block), a plurality of resonators 102 extending from a top surface toward a bottom surface of the dielectric block 101, a plurality of adjusting patterns 103 provided over the top surface of the dielectric block 101, input and output electrodes 104 and metallized patterns 105 provided over side surfaces and the bottom surface of the dielectric block 101.

The inner conductors are formed within inner walls of the resonators 102.

These inner conductors are connected to the adjusting patterns 103 at the top surface of the dielectric block 101. The inner conductors are connected to the metallized patterns 105 at the bottom surface of the dielectric block 101. The metallized patterns 105 are grounded.

SUMMARY OF THE INVENTION

It is an object of the present invention to provide a dielectric filter with an attenuation pole and having less antenna return loss in a passband as compared to prior art filters.

It is another object of the present invention to provide a dielectric filter with and attenuation pole having a sharp attenuation characteristic with fewer elements than that of prior art filters.

To achieve the above objects, the present invention provides a dielectric filter with an attenuation pole comprising: a dielectric block having a top surface, a bottom surface, and side surfaces, the bottom surface and side surfaces being covered by an outer conductor; a plurality of resonators having inner conductors extending from the top surface toward the bottom surface; a coupling means for capacitively coupling adjacent ones of the plurality of resonators; two electrodes for applying a voltage to the dielectric block; and an insulated cable positioned over the plurality of resonators.

The above and other objects, features and advantages of the present invention will become more apparent from the following description taken in conjunction with the accompanying drawings.

DESCRIPTION OF THE PREFERRED EMBODIMENT

Figure 1:
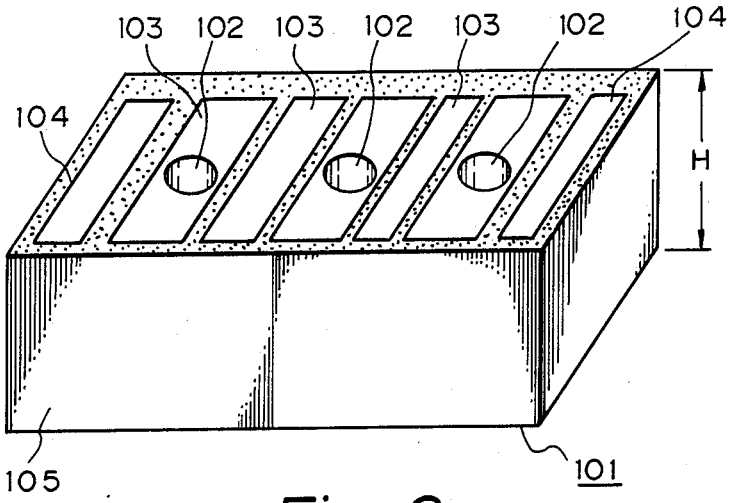
FIG. 1 is a perspective view of a dielectric filter having no attenuation pole.

A preferred embodiment of the present invention will be described with reference to FIGS. 2 through 5.

The dielectric filter of the present invention is composed of a uniform dielectric single-block 201 (hereinafter referred to as simply the dielectric block) which may be fabricated of dielectrics including $TiO_2$ and BaO. The dielectric block 201 has dimensions of 9.4 mm in height $\times$6.0 mm in width$\times$28.1 mm in length. Hollow resonators 202, 203, 204, 205, respectively extend from a top surface toward a bottom surface of the dielectric block 201 and are arranged in parallel with each other to form first to fourth resonator stages.

The resonators 202 through 205 respectively have inner conductors 212, 213, 214, 215 formed in the inner walls thereof. The inner conductors 212 through 215 each having one end thereof respectively connected to adjusting patterns 222, 223, 224, 225 formed over the top surface of the dielectric block 201; the inner conductors 212 through 215 each have another end thereof respectively connected to an outer conductor 206 formed and extended over side surfaces and the bottom surface of the block 201. Formed between the adjusting patterns 222 through 225 are adjusting patterns 231, 232, and 233. These patterns 222–225 and 231–233 are for adjusting the resonant frequency of the plurality of resonators 202–205 and for adjusting the capacitive coupling between the plurality of resonators 202–205. Respectively formed at either end of the top surface of the dielectric block 201 are electrodes 250 and 251. Preferably, the inner conductors, adjusting patterns, the outer conductor, and the electrodes are respectively plated with copper, or slver, etc. An insulated cable 270 has one end connected to an electrode 250 and has its other end connected either to the outer conductor 206 or to the electrode 251 (not shown in drawings). The insulated cable 270 is disposed over the top surface of the dielectric block 201 across the resonators 202–205.

An electric signal applied to the electrode 250 generates electromagnetic field by the first stage resonator 202. The resultant electromagnetic field is transmitted to the second resonator 203 via the coupling capacitance between the adjusting pattern 231 adjacent to the first resonator 202 and the first resonator 202 and the coupling capacitance between the adjusting pattern 231 and the second resonator 203. Likewise, the electromagnetic field is successively transmitted to the third and fourth resonators 204 and 205 via the coupling capacitance between adjusting patterns 232 and 233 and the resonators. The fourth resonator 205 transmits the electromagnetic field transmitted from the third resonator 204 to the electrode 251 by capacitive coupling in the embodiment illustrated in FIG. 2. The electromagnetic field transmitted to the electrode 251 is transmitted to a load connected to the electrode 250 as an electric signal. The electric signal applied to the electrode 250 is also transmitted to the outer conductor 206 via the insulated cable 270. Since the dielectric filter according to this invention includes a quarter-wave length coaxial resonator, the electromagnetic field becomes maximum at the top surface of the dielectric block 201. The insulated cable 270 is disposed over the top surface of the dielectric block 201, so there exists coupling capacitance between each resonator 202, 203, 204, 205 and insulated cable 270.

Figure 2:
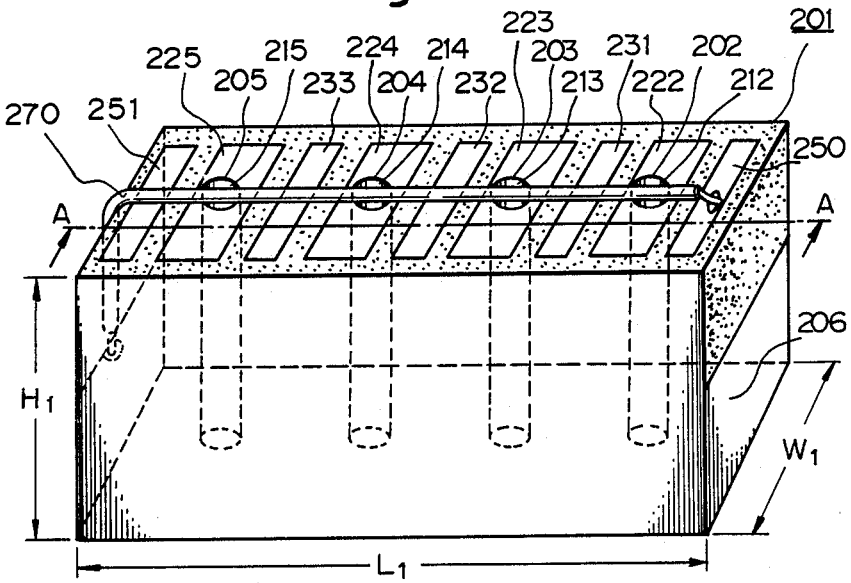
FIG. 2 is a perspective view of a dielectric filter with an attenuation pole according to an embodiment of the present invention.
Figure 3:
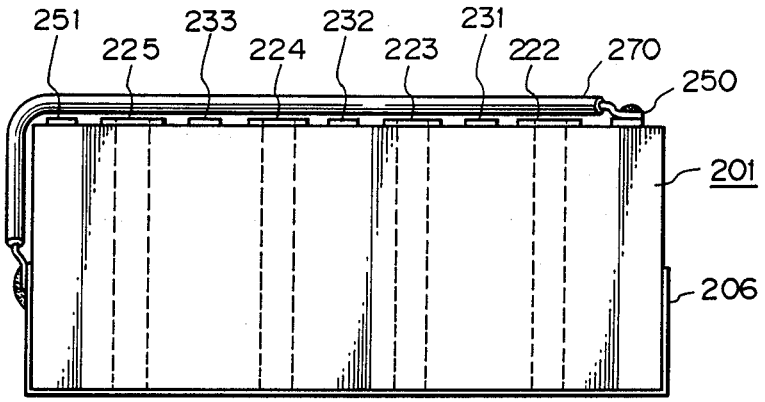
FIG. 3 is a cross-sectional view taken along A—A of the dielectric filter with an attenuation pole in FIG. 2.
Figure 4:
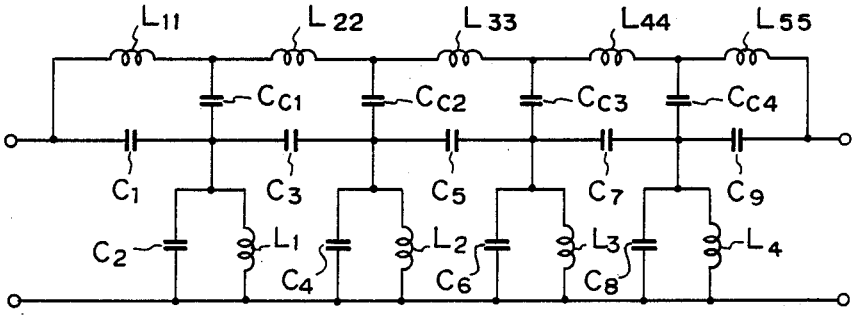
FIG. 4 is an equivalent circuit of the dielectric filter with an attenuation pole in FIG. 2.

Each element as illustrated in FIG. 2 corresponds to an equivalent circuit in FIG. 4 which have relations listed hereunder.

| FIG. 2 | FIG. 4 |
|---|---|
| Resonators 202, 203, 204, 205 | Parallel Resonators (L1, C2), (L2, C4), (L3, C6), (L4, C8) |
| Capacitance between Electrode 250 and Resonator 202 | Coupling Capacitor C1 |
| Capacitance between Resonator 202 and Resonator 203 | Coupling Capacitor C3 |
| Capacitance between Resonator 203 and Resonator 204 | Coupling Capacitor C5 |
| Capacitance between Resonator 204 and Resonator 205 | Coupling Capacitor C7 |
| Capacitance between Resonator 205 and Electrode 251 | Coupling Capacitor C9 |
| Capacitance between Insulated cable 270 and Each Resonator | Coupling Capacitors Cc1, Cc2, Cc3, Cc4 |
| Self-inductance of Insulated cable 270 | Inductance L11, L22, L33, L44, L55 |

As shown in FIG. 4, a parallel resonator circuit is composed of the coupling capacitors C1, C3, C5, C7, C9, the inductance L11, L22, L33, L44, L55, and the coupling capacitors Cc1, Cc2, Cc3, Cc4. Attenuation pole is appeared in the attenuaton characteristic of the dielectric filter due to the parallel resonator circuit. That is, a resonant frequency of the parallel resonator circuit provides a transmission/zero characteristic, which causes infinite attenuation so as to generate the pole.

Figure 5:
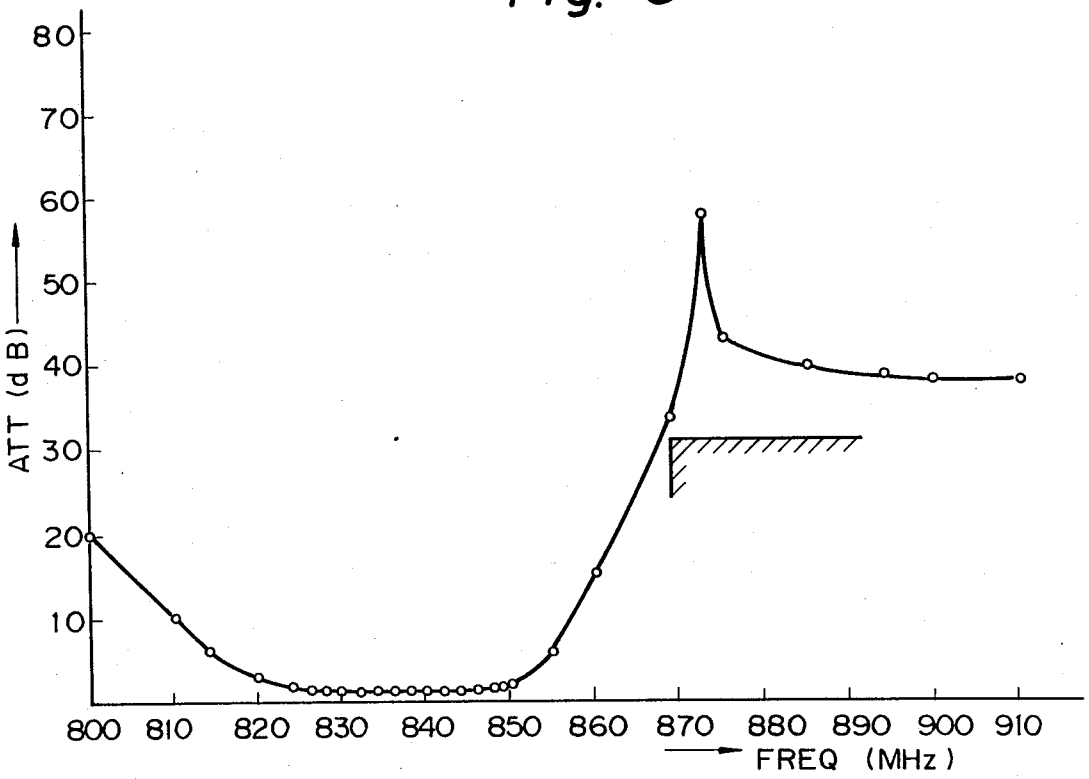
FIG. 5 is a view used in explaining the frequency-attenuation rate characteristic of a dielectric filter with an attenuation pole.

When the dielectric filter is employed as an antenna for the mobile phone system, the attenuation characteristic relative to the frequency is illustrated in FIG. 5. An advanced mobile phone system (AMPS) having transmissin lines of 832 channels has an attenuation standard of 31 dB at 869 MHz. The attenuation according to the present inventin becomes 34 dB which meets the attenuation standard of the AMPs.

What is claimed is:

1. A dielectric filter with an attenuation pole comprising:
   - a dielectric block having a top surface and a bottom surface and side surfaces, said bottom surface and side surfaces being covered by an outer conductor;
   - a plurality of resonators arranged in a row and each having respective inner conductors extending from said top surface toward said bottom surface;
   - a plurality of coupling means for respectively capacitively coupling adjacent ones of said plurality of resonators to each other;
   - two electrodes for supplying a voltage to said dielectric block; and
   - an insulated cable disposed over said plurality of resonators so as to be coupled thereto.

2. A dielectric filter with an attenuation pole according to claim 1, wherein said resonators are disposed at predetermined distances from one another.

3. A dielectric filter with an attenuation pole according to claim 1, wherein said plurality of coupling means are patterns formed on said top surface of said dielectric block.

4. A dielectric filter with an attenuation pole according to claim 1, wherein said insulated cable has one end connected to said outer conductor and another end connected to one of said two electrodes.

5. A dielectric filter with an attenuation pole according to claim 3, wherein said patterns are patterns which are each formed between adjacent ones of said plurality of resonators.

6. A dielectric filter with an attenuation pole according to claim 1, wherein said insulated cable has at least one end connected to one of said two electrodes.

7. A dielectric filter with an attenuation pole according to claim 1, wherein said plurality of coupling means are patterns formed on said top surface of said dielectric block and are respectively connected to said inner conductors of said plurality of resonators.

8. A dielectric filter with an antenuation pole according to claim 7, wherein said plurality of coupling means include adjusting patterns respectively disposed between adjacent ones of said plurality of resonators for adjusting the coupling capacitance therebetween.

9. A dielectric filter with an attenuation pole comprising:
   - a dielectric block having a top surface and a bottom surface and side surfaces, said bottom surface and side surfaces being covered by an outer conductor;
   - a plurality of resonators arranged in a row and each having respective inner conductors exending from said top surface toward said bottom surface;
   - a plurality of adjusting means for respectively adjusting resonant frequencies of said plurality of resonators;
   - a plurality of coupling means for respectively capacitively coupling adjacent ones of said plurality of resonators to each other.
   - two electrodes for supplying a voltage to said dielectric block; and
   - an insulated cable disposed over said plurality of resonators so as to be coupled thereto.

10. A dielectric filter with an attenuation pole according to claim 6, wherein said resonators are disposed at predetermined distances from one another.

11. A dielectric filter with an attenuation pole according to claim 9, wherein said plurality of coupling means are patterms formed on said top surface of said dielectric block.

12. A dielectric filter with attenuation pole according to claim 6, wherein said insulated cable has one end connected to said outer conductor and another end connected to one of said two electrodes.

13. A dielectric filter with an attenuation pole according to claim 9, wherein said adjusting means are patterns formed on said top surface of said dielectric block and are respectively connected to said inner conductors of said plurality of resonators.

14. A dielectric filter with an attenuation pole according to claim 11, wherein said patterns are formed between adjacent ones of said plurality of resonators.

15. A dielectric filter with an attenuation pole according to claim 9, wherein said insulated cable has at least one end connected to one of said two electrodes.

16. A dielectric filter with an attenuation pole comprising:
   - a dielectric block having a top surface and a bottom surface and side surfaces, said bottom surface and side surfaces being covered by an outer conductor;
   - a plurality of resonators arranged in a row and each having respective inner conductors extending from said top surface toward said bottom surface, said plurality of resonators being disposed in parallel with each other;

a plurality of adjusting means for respectively adjusting resonant frequencies kof said plurality of resonators;

a plurality of coupling means for respectively capacitively coupling adjacent ones of said plurality of resonators to each other;

two electrodes for supplying a voltage to said dielectric block; and an insulated cable disposed over said plurality of resonators so as to be coupled thereto.

17. A dielectric filter with an attenuation pole according to claim 16, wherein said plurality of resonators are disposed at predetermined distances from one another.

18. A dielectric filter with an attenuation pole according to claim 16, wherein said plurality of coupling means are patterns formed on said top surface of said dielectric block.

19. A dielectric filter with attenuation pole according to claim 12, wherein said insulated cable has one end connected to said outer conductor and another end connected to one of said two electrodes.

20. A dielectric filter with an attenuation pole according to claim 16, wherein said plurality of adjusting means are patterns formed on said top surface of said dielectric block and are respectively connected to said inner conductors of said plurality of resonators.

21. A dielectric filter with an attenuation pole according to claim 18, wherein said patterns are formed between adjacent ones of said plurality of resonators.

22. A dielectric filter with an attenuation pole according to claim 16, wherein said insulated cable has at least one end connected to one of said two electrodes.

* * * * *